United States Patent [19]

Caricchio, Jr. et al.

[11] 4,100,039

[45] Jul. 11, 1978

[54] METHOD FOR PLATING PALLADIUM-NICKEL ALLOY

[75] Inventors: Jerome Joseph Caricchio, Jr., Binghamton; Edward Robert York, Endicott, both of N.Y.

[73] Assignee: International Business Machines Corporation, Armonk, N.Y.

[21] Appl. No.: 740,901

[22] Filed: Nov. 11, 1976

[51] Int. Cl.[2] ..... C25D 3/56

[52] U.S. Cl. ..... 204/43 N

[58] Field of Search ..... 204/43 N, 123

[56] References Cited

U.S. PATENT DOCUMENTS

| | | | |
|---|---|---|---|
| 3,580,820 | 5/1971 | Yamamura et al. | 204/43 N |
| 3,677,909 | 7/1972 | Yamamura et al. | 204/43 N |
| 3,933,602 | 1/1976 | Henzi et al. | 204/44 |

FOREIGN PATENT DOCUMENTS

| | | | |
|---|---|---|---|
| 2,328,243 | 12/1974 | Fed. Rep. of Germany | 204/43 N |
| 25,607 | 7/1971 | Japan | 204/43 N |
| 25,604 | 7/1971 | Japan | 204/43 N |
| 33,177 | 8/1972 | Japan | 204/43 N |
| 379,675 | 4/1973 | U.S.S.R. | 204/43 N |
| 212,692 | 2/1968 | U.S.S.R. | 204/43 N |

OTHER PUBLICATIONS

Frederick A. Lowenheim, "Modern Electro-Plating", pp. 19 & 20, (1963).

*Primary Examiner*—G. L. Kaplan

*Attorney, Agent, or Firm*—Sughrue, Rothwell, Mion, Zinn and Macpeak

[57] ABSTRACT

A palladium-nickel alloy is plated on electrical components, such as frames, pins, connectors and in general various types of electrical contacts. The palladium-nickel alloys are deposited from a plating bath containing a palladosammine chloride, nickel sulfamate, ammonium sulfamate and ammonium hydroxide, the latter operative to solubilize the metals into the ammonia complex and to maintain the necessary bath pH. The bath can be used for either rack plating at current densities of 10 to 25 amperes per square foot or to barrel plate at a plating current of 1 to 3 amperes per square foot.

5 Claims, 2 Drawing Figures

METHOD FOR PLATING PALLADIUM-NICKEL ALLOY

BACKGROUND OF THE INVENTION

Electrical components which are used to establish various circuit contacts should have a low, stable contact resistance, which can be assured only if the contact metal is a good conductor and does not substantially deteriorate with time. Noble metals, such as gold and the metals of the platinum family have very low chemical reactivity, essentially do not oxidize or form sulfides, and therefore meet the foregoing requirements. However, the cost of the noble metals adversely affect the economies of making low-energy, low-cost circuit contacts therefrom.

A noble metal may be electrodeposited on a base metal substrate to give the desired low energy contact resistance, but in any event the base metal substrate must be essentially pore free and have good conductivity to take proper advantage of the noble metal being electrodeposited thereover. For example, if a base metal is porous, deposits can cause films to be formed on the contact, which films are produced by corrosion products resulting either from the tarnishing of the base metal substrate or from a directly coupled corrosion between the base substrate and the noble metals.

Palladium, because it is a less expensive metal than gold and is a relatively unreactive member of the platinum family, can effectively replace gold for some contact applications. Palladium does wear better than gold and the density of palladium is lower than the density of gold, so that for equal thicknesses, the relative expense of the same thickness of the metal contact can be decreased through the use of palladium. Where it is essential to use an external gold layer, advantages can be obtained by applying a base layer of palladium as a portion of the total thickness of the substrate and plating gold thereover. However, the cost of palladium is still relatively significant and any ability to lower the cost of the substrate or final plated product has obvious economic advantages to the user.

While the use of palladium as a substitute metal for gold as an electrical component contact material is relatively well known, palladium alloy material is not. U.S. Pat. No. 3,925,170, issued Dec. 9, 1975, does disclose a plating bath for producing bright palladium electrodepositions which uses small amounts of cobalt or nickel as a brightener for the electrodeposit, but does not use sufficient quantities of either to substantially affect the cost of the plated contact. In one example given, the nickel added to the bath is substantially less than one quarter of the palladium ion included in the bath and since palladium plates faster than nickel, the resultant nickel in the electrodeposit would be expected to be significantly less than 5% of the total deposit.

OBJECTS AND SUMMARY OF THE INVENTION

Accordingly, it is a principal object of the present invention to provide a new method and composition for plating which overcomes the foregoing disadvantages of the prior art.

It is a further object of the present invention to provide an improved method and composition for electroplating palladium-nickel alloy.

A still further object of the present invention is to provide an improved method and composition for high speed electroplating of uniform, bright palladium-nickel deposits over a wide operating current density range.

A still further object of the present invention is to provide an improved method and composition for plating palladium-nickel alloys which may be used for both rack plating and barrel plating.

The foregoing and other objects, features and advantages are accomplished according to the one aspect of the invention which utilizes a plating bath comprised of approximately 6 grams per liter of palladium ion from palladosammine chloride; approximately 12 grams per liter of nickel ion from a nickel sulfamate; about 40 grams per liter of ammonium sulfamate; and, 30 to 50 cc per liter of ammonium hydroxide (29% $NH_3$). The ammonium hydroxide is used to solubilize the metals into their ammonia complexes and to maintain a pH of between 8.8 and 9.6, preferably 9.0 to 9.3. The bath is maintained at an ambient temperature of between 25° and 30° C and for rack plating, the components are placed in the bath and operated at plating currents of 10 to 25 amperes per square foot. For barrel plating, the components are put in the bath and a plating current of 1 to 3 amperes per square foot is maintained.

A further advantage of the present invention results because the palladium-nickel alloy deposits have excellent adhesion to nickel underplates which are commonly used as substrates, obviating the need for any adhesion promotion steps, such as a surface activation or metallic strike.

Other objects, features and advantages of the present invention will become more apparent from the following more particular description of a preferred embodiment of the invention; as illustrated in the accompanying drawings.

DESCRIPTION OF PREFERRED EMBODIMENT

Figure 2:
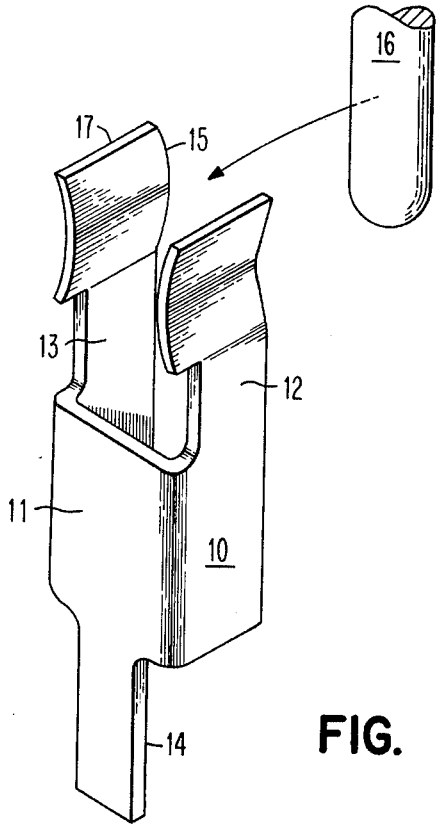
FIG. 2 is an isometric drawing of an electrical connector device which is palladium-nickel plated by the method of the present invention.

Referring first to FIG. 2, there is shown a zero or low insertion force, low actuation force electrical connector 10 adapted for incorporation into a printed circuit board, connector housing or the like, and suitable for card edge, input/output, array or dual-in-line module applications. The connector comprises a bifurcated spring yoke 11 having a pair of complementary, flat, longitudinally and upwardly extending arms 12 and 13. A mounting post or stem 14 extends downwardly from the lower edge of the central portion or base of yoke 11. The upper extremity of each arm 12, 13 is machine fabricated to provide a cylindrical or barrel-shaped contact surface 15 in opposing and spaced apart relationship at a distance less than the diameter of a male connector pin 16 to be introduced therebetween.

Prior to being palladium-nickel alloy plated, electrical connector 10 can be run through a conventional nickel plating process. Connector 10 is processed, for example, in 12 inch strips containing 110–120 connectors each. A number of these strips are mounted into a suitable plastic plating fixture or rack and electrical contact made at one end of each strip with each commoned to a single metal strip at the top of the fixture. The strip rack is processed through a clean line of a hot alkaline cleaner, hot 25% sulfuric acid, persulfate etchant, and a nickel plating bath, if necessary. Water rinses are included after each operation.

Figure 1:
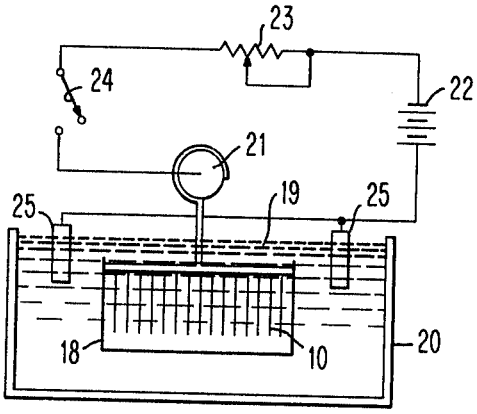
FIG. 1 shows an apparatus for rack plating parts with palladium-nickel in accordance with the present invention.

Referring to FIG. 1, after the nickel plating operation the rack 18 is immersed in the palladium-nickel bath 19 contained in the metal tank 20. The strips of the electrical connectors 10 are suitably fixed to a cathode rod 21 for electrical contact and agitation. The cathode rod 21 and rack 18 are moved back and forth horizontally by suitable motor means, not shown, to supply rack agitation. The palladium-nickel bath solution 19 is also agitated by suitable pumping action. The cathode rod 21 is connected through an electrical circuit including a battery 22, a variable resistor 23, and a switch 24 to a pair of expanded platinized tantalum anodes 25 to establish the desired potential through the plating solution. The cathode is suspended equidistant between the two anodes and the anodes have a total area which is at least twice that of the cathode. The anodes are in spaced relation with the connector strips 10 in the rack. An operating current density range of 1.5 to 2.5 amps per square decimeter is preferred and a current of about 1.5 amps per square decimeter would be applied for 5–5.5 minutes at a temperature of 75° F to 82° F. As is well known, the electrolysis phenomenon will cause the connectors 10 to be coated with palladium-nickel.

After plating, the strip rack is rinsed in hot deionized water, blown off lightly with an air nozzle, and dried in a forced air oven for about 5–10 minutes. The plated strips are removed from the rack, packaged, and the process is repeated.

The plating solution 19 comprises about 3 to 6 grams per liter of palladium ion derived, for example, from palladosammine chloride and about 12 grams per liter of nickel ion derived, for example, from a nickel sulfamate, nickel chloride or nickel sulfate. The ions are contained in an electrolyte comprising from 10 to 50 grams per liter of ammonium sulfamate, ammonium sulfate or ammonium chloride and in addition will contain from 30 to 50 cc per liter of 29% ammonium hydroxide. A suitable sulfite ion in a concentration between 1 and 1000 parts per million, but not in excess of 1000 parts per million, may also be contained in the solution. The sulfite ion may, for example, be derived from sodium sulfite, $Na_2SO_3$. The ammonium hydroxide is maintained in the solution to solublize the metals into ammonia complex in addition to maintain the desired pH of the plating solution. The plating solution pH is maintained between 8.0 and 9.5, with a preferred range of between 9.0 and 9.3.

The concentration of the nickel ion in the plating solution is varied depending upon the palladium-nickel ratio that is required in the plated alloy. In the plating process, the preferred operating current density range is from 0.1 to 0.3 amps per square decimeter for barrel plating and from 1.0 to 2.5 amps per square decimeter for rack plating.

There are various substrates upon which the palladium-nickel alloy from the solution 19 can be plated, such as for example on a nickel substrate, a copper substrate or a copper-beryllium alloy substrate. These are mentioned by way of example and not limitation. A particular advantage of the alloy plating of the present invention is that when plating on a nickel substrate it is not necessary to use any intermediate adhesion promotion steps such as surface activation or metallic strike, since the palladium-nickel alloys deposit and have excellent adhesion on nickel underplates.

In the preferred plating solutions, both the palladium ions and the nickel ions are maintained in solution as palladium ammonia complexes and nickel ammonia complexes, respectively. One of the purposes of the use of the ammonium hydroxide is to maintain the necessary ammonium complexes of the metals and thereby prevent any precipitation of the metal hydroxides from the solution. The addition of the sulfite ion to the bath is found to yield a deposit having a pleasing uniform, satin bright appearance and is also found to significantly broaden the operating current density range at which the electrodeposits may be obtained. Specific examples of the implementation of the present invention are as follows:

EXAMPLE I

A bath is prepared by adding approximately 6 grams per liter of palladium ion derived from palladosammine chloride along with 12 grams per liter of a nickel ion derived from nickel sulfamate, nickel chloride or nickel sulfate to an electrolyte consisting of between 10 and 50 grams per liter of ammonium sulfamate, ammonium sulfate or ammonium chloride. To this solution is added between 30 and 50 cc per liter of 29% ammonium hydroxide sufficient to maintain a pH between 9.0 and 9.3. With the bath held at an ambient temperature of between 25 and 35° C. plating is carried out under a current of about 1.4 to 1.5 amperes per square decimeter for about 5 minutes. During the plating, the rack is agitated through suitable reciprocation of the cathode rack head and, in addition, the plating solution is agitated through a pumping station. A uniform palladium-nickel alloy coating of about 2–3 microns thickness results, with a ratio of about 75% palladium to 25% nickel in the plated alloy.

EXAMPLE II

The palladium solution is the same as that in Example I except that a sodium sulfite is added to the plating solution to yield a sulfite ion concentration of about 90 parts per million. This results when approximately 1 gram of sodium sulfite is added to approximately 7 liters of the plating bath.

EXAMPLE III

The plating solution is produced as shown in Example I except that about 3 grams per liter of palladium ion derived from palladosammine chloride is used rather than the 6 grams per liter of Example I. The resultant palladium-nickel alloy plated is in the ratio of about 50% palladium to 50% nickel.

In the particular utilization of the invention, the relative concentrations of the palladium and nickel ions in solution can be varied dependent upon the design requirements or constraints. However, it has been generally found that when the amount of nickel in the alloy plated exceeds 50%, some of the desirable characteristics of the palladium plate are significantly diminished. On the other hand, once the nickel in the final plate becomes much less than 25% of the alloy, the economic advantages of using the alloy plate according to the present invention are significantly diminished.

While the invention has been particularly shown and described with reference to a preferred embodiment thereof, it will be understood by those skilled in the art that various changes in form and details may be made therein without departing from the spirit and scope of the invention. It is therefore intended that the invention not be limited to the specifics of the foregoing preferred embodiment, but rather to embrace the full scope of the following claims.

We claim:

1. A method for depositing a palladium-nickel alloy on a substrate, comprising the steps of:

subjecting an anode to an aqueous bath solution consisting essentially of 3 to 6 grams per liter of palladium ion derived from palladosammine chloride, about 12 grams per liter of nickel ion derived from the group consisting of nickel sulfamate, nickel chloride and nickel sulfate, from 10 to 50 grams per liter of ammonium sulfamate, ammonium sulfate or ammonium chloride, between 1 and 1000 parts per million of a sulfite ion derived from sodium sulfite and sufficient 29% ammonium hydroxide to solubilize the palladium and nickel metal ions into soluble ammonia complexes and to maintain a pH between 8.8 and 9.6;

immersing the substrate to be coated in said solution and in spaced relation to said anode;

applying a plating current density of 0.3 to 3.0 amperes per square decimeter to said solution and substrate;

agitating both said solution and substrate; and maintaining said solution at ambient temperature and without increasing the above concentrations of ingredients in the bath during the plating process.

2. The invention according to claim 1 wherein said palladium and nickel ion concentrations are chosen, respectively, to yield between 75% and 50% palladium and between 25% and 50% nickel in the plated palladium-nickel alloy.

3. The method according to claim 1 wherein the solution is maintained at a pH between 9.0 and 9.3.

4. The method according to claim 1 wherein said solution consists of palladosammine chloride, nickel sulfamate, ammonium sulfamate, sodium sulfite and ammonium hydroxide.

5. The method according to claim 1 wherein said substrate surface is formed of a metal chosen from the group consisting of nickel, copper and a copper-beryllium alloy.

* * * * *